United States Patent [19]

Hauser et al.

[11] Patent Number: 4,718,365

[45] Date of Patent: Jan. 12, 1988

[54] BLIND-STITCH SEWING MACHINE

[76] Inventors: Georg Hauser, Strassbergerstr. 24, D-8000 Munich 40; Rolf Höggenstaller, Sandbergstr. 6, D-8031 Wessling, both of Fed. Rep. of Germany

[21] Appl. No.: 869,681

[22] Filed: Jun. 2, 1986

[30] Foreign Application Priority Data

Jun. 3, 1985 [DE] Fed. Rep. of Germany ..... 3519849

[51] Int. Cl.[4] ..... D05B 1/24

[52] U.S. Cl. ..... 112/176; 112/121.11

[58] Field of Search ..... 112/176, 177, 178, 121.11, 112/267.1, 268.1, 121.12, 121.13

[56] References Cited

U.S. PATENT DOCUMENTS 2,895,442 7/1959 Parry ..... 112/176 X
3,286,667 11/1966 Roth ..... 112/176

FOREIGN PATENT DOCUMENTS 2120558 11/1972 Fed. Rep. of Germany .
2709533 2/1978 Fed. Rep. of Germany .
2430845 1/1980 Fed. Rep. of Germany .
3018886 12/1980 Fed. Rep. of Germany .
2848612 5/1981 Fed. Rep. of Germany .

OTHER PUBLICATIONS

Phytron reprint; Ing. S. Auerhammer, 12-1970.

DNZ, Nr. 9/1980, p. 32.

*Primary Examiner*—Peter Nerbun
*Attorney, Agent, or Firm*—Bacon & Thomas

[57] ABSTRACT

The blind-stitch sewing machine includes a fabric bender adjustable between a sewing position wherein the material being sewn will bulge into the arcuate trajectory of the arc needle and a release position allowing the material to be sewn to be inserted and respectively the material having been sewn to be removed, this adjustment being effected through a rocker shaft. This rocker shaft cooperates with a stop defining the sewing position of the fabric bender. The stop is adjustable for setting the stitch-depth of the arc needle into the particular material to be sewn in order to assure a corresponding distance of the fabric bender in the sewing position from the trajectory of the arc needle. To allow the operating personnel to more easily, more rapidly and more accurately set the stitch-depth of the arc needle, whereby operation is facilitated, idle times are shortened and better sewing results are achieved, a stepping drive for the adjustable stop and an electric control circuit for the stepping drive are provided which electric control circuit is adapted to be actuated to set the stop by means of the stepping drive to correspond to the particular, desired-stitch depth of the arc needle.

6 Claims, 7 Drawing Figures

BLIND-STITCH SEWING MACHINE

Figure 1:
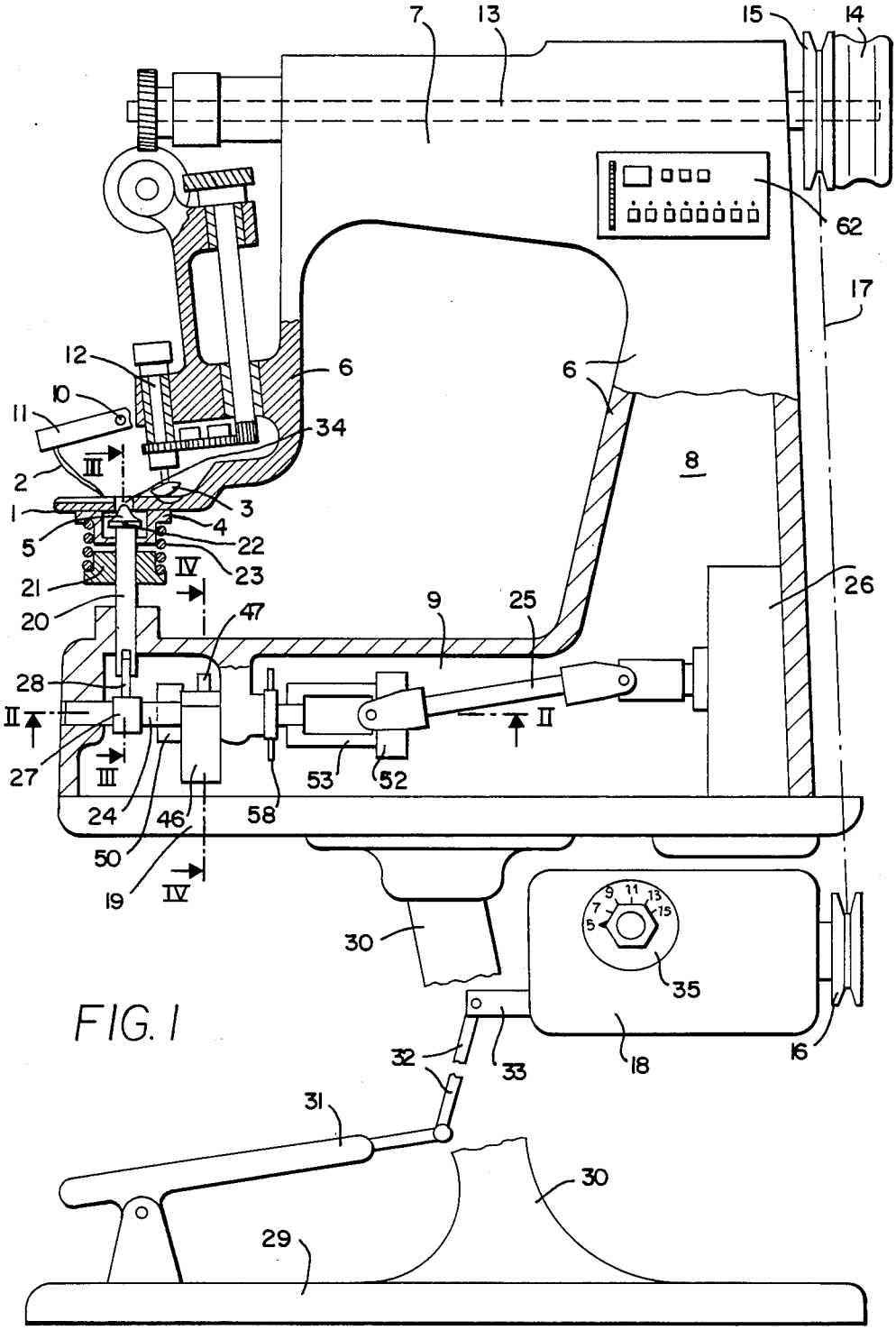

The invention concerns a blind-stitch sewing machine of the species cited in the preamble of the patent claim 1.

Such warp-stitch blind-stitch sewing machines for point-wise sewing by means of a predetermined number of stitches forming a so-called point-lock are known (German laid-open specification No. 21 20 558). The adjustable stop for the rocking shaft actuating the fabric bender consists of a screw which can be manually turned in the lower arm of the blind-stitch sewing machine using an external rotation knob in order to so adjust the distance between the fabric bender in the sewing position and the trajectory of the arc needle that the desired stitching depth of the arc needle into the particular material to be sewn is obtained thereby, this depth depending not only on the sewing position of the fabric bender or its present distance from the trajectory of the arc needle, but also on the fabric to be sewn, in particular on the number and/or the thickness of the layers of the material to be sewn, and this depth being different with the same sewing position of the fabric bender for different fabrics to be sewn.

It is the object of the invention to create a blind-stitch sewing machine of the species as stated in the preamble of the patent claim 1 for which the operating personnel may set more accurately, more rapidly and an in an easier manner the stitching depth of the arc needle, whereby the work is facilitated, idle times are shortened and sewing quality is improved.

This problem is solved by the features stated in the characterizing part of the patent claim 1. Advantageous embodiments of the blind-stitch sewing machine according to the invention are stated in the remaining patent claims.

Electric stepping motors, used for diverse purposes, and which may drive a gear unit and may allow operating with feedback are part of the general state of the art (brochure "phytron", 1970). Also, it is known to use microprocessors in electric control circuits, including those of sewing machines, and to provide acoustic signal generators in sewing machines ("DNZ", Nr. 9/1980, p 32). Further electro-optical pulse generators for sewing machine drives are known, which include light emitters and sensors and a masking disk for the light beams between the emitters and the sensors (German patent specification No. 28 48 612).

The state of the art moreover includes electronically controlled sewing machines wherein various stitching patterns may be pre-selected which then are automatically carried out. To that end the needle bar is correspondingly adjusted and the motion of the fabric feeder is correspondingly changed, each through an associated setting drive connected to an electric control circuit. This electric control circuit includes a read-only memory (ROM) storing the data for the stitching patterns which can be fetched by means of a keyboard (German published specification No. 24 30 845). Additionally a read-write memory (RAM) may be provided, whereby the operating personnel also may store stitching patterns of their own selection (German laid-open specification No. 27 09 533).

Lastly a sewing machine is known, into which the essential data for the particular sewing process may be fed in order to display the particular required accessory equipment and the particular necessary settings, provision further being made to automatically carry out some of these settings, namely by means of an electric stepping motor which may be followed by a reduction gear unit. The several possible settings of the particular adjustable means of the sewing machine are stored in a programmable memory from which they can be fetched for instance by means of a keyboard in order to adjust accordingly the said means of the sewing machine through the stepping motor, starting from a certain initial null position being determined by a position sensor and from which the electric stepping motor rotates by a number of steps corresponding to the particular fetched setting. A feedback system may be provided which acts to provide an optical display when said means has reached the predetermined setting. However the known sewing machine is not a blind-stitching machine. A fabric bender is absent, furthermore there is no adjustment mechanism at all for this bender with adjustable elements to assure a specific distance between the fabric bender in the sewing position and the trajectory of the arc needle (German laid-open specification No. 30 18 886).

The invention can be implemented both in those blind-stitching machines wherein the fabric bender can be reciprocated at the fixed lower machine arm between the sewing position and the release position on one hand, and on the other wherein the fabric bender can be moved to and fro between the sewing position and the release position by swinging the lower machine arm correspondingly, the adjustable stop not cooperating with a rocking shaft to actuate the fabric bender but rather with a rocking shaft to actuate the lower arm or with the lower arm itself. It is not basically necessary that the lower arm and the upper arm of the blind-stitching machine extend one above the other, rather the invention also can be carried out with blind-stitching machines with two arms extending side by side, each carrying the arc needle and the gripper cooperating therewith or respectively the fabric bender.

Figure 2:
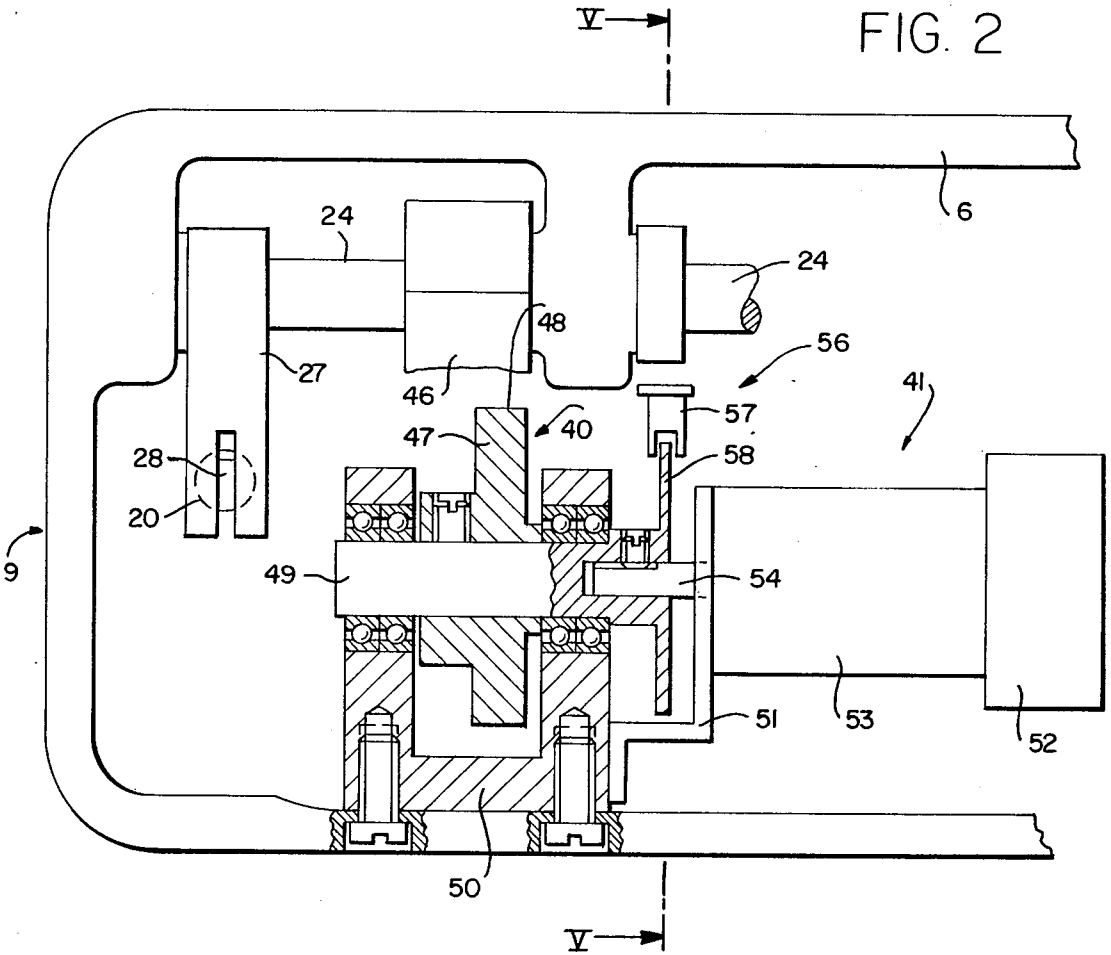
Figure 3:
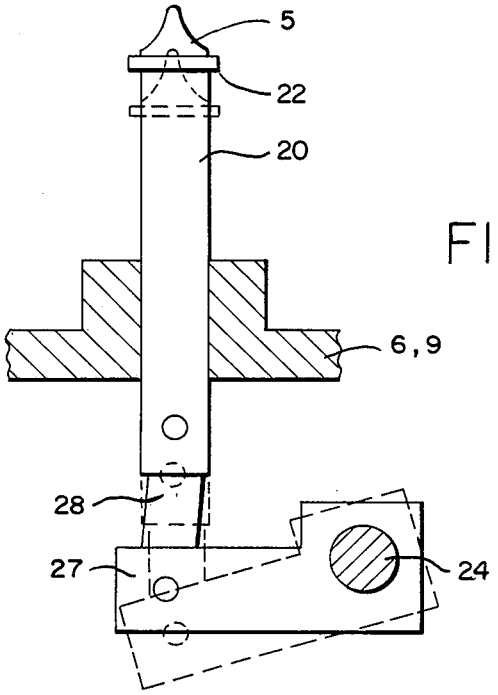
Figure 4:
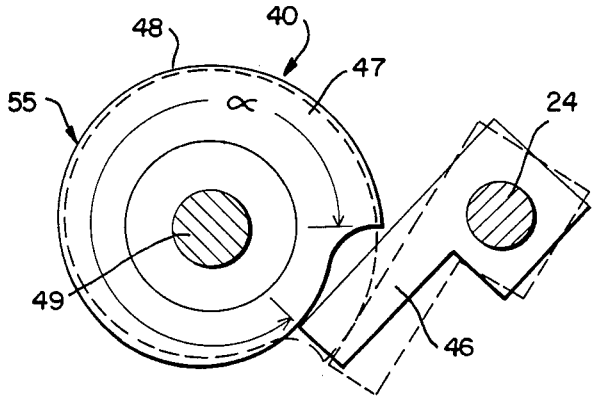
Figure 5:
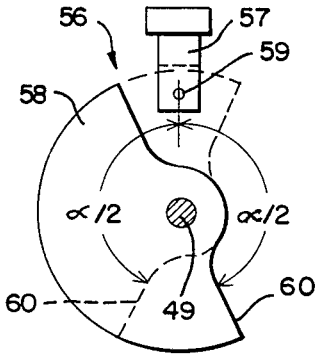
Figure 6:
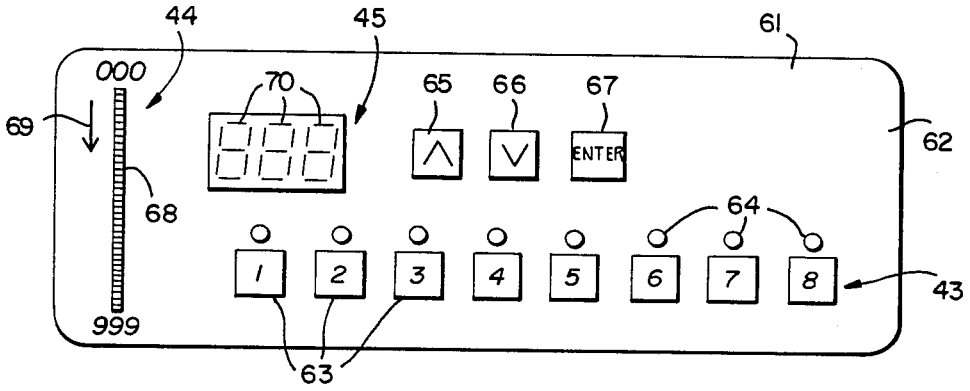
Figure 7:
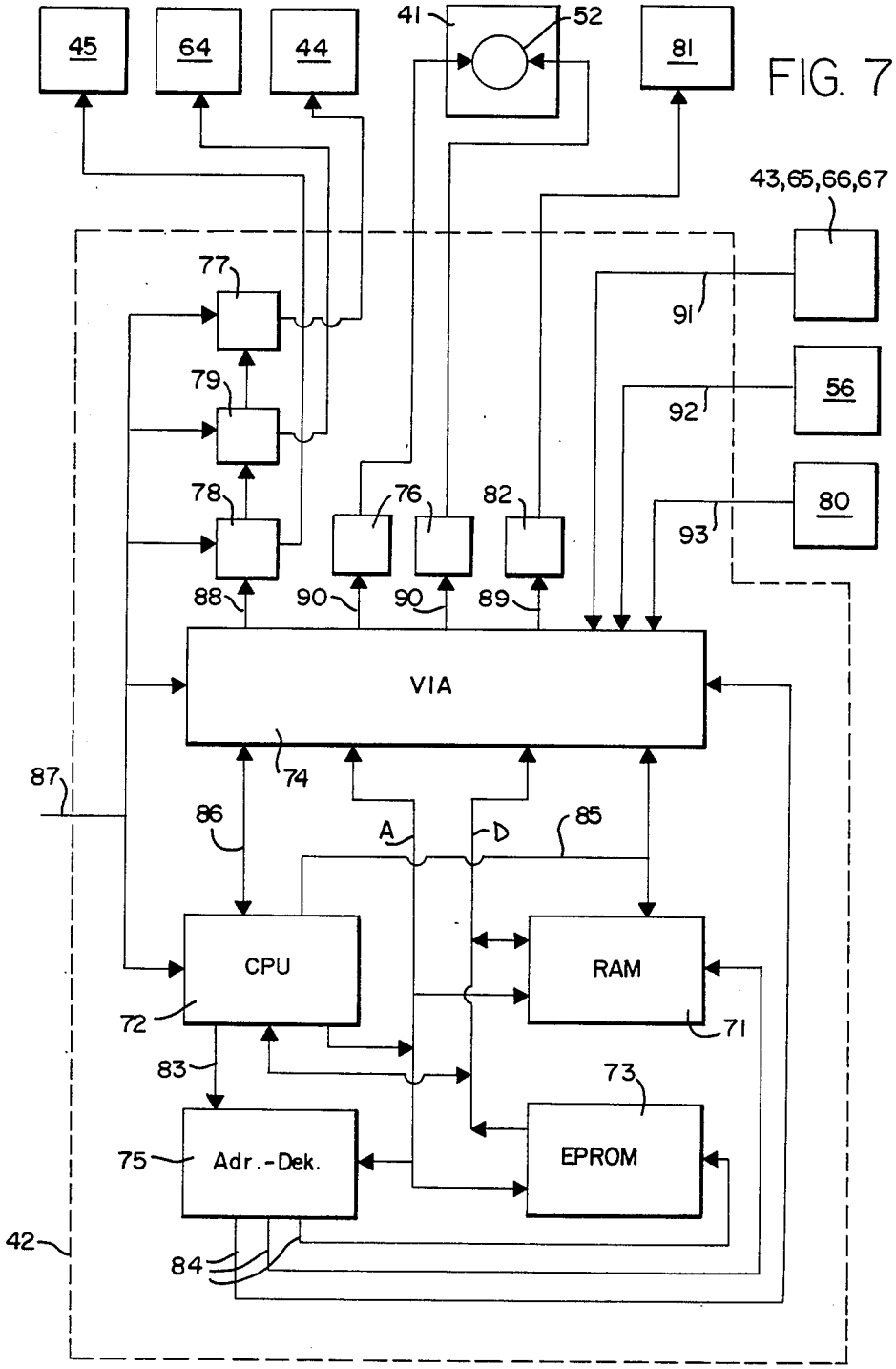

One embodiment of the blind-stitch sewing machine of the invention is described below by way of example with reference to schematic drawings, wherein:

FIG. 1 is a side view in partial longitudinal section,

FIG. 2 is the section along line II—II of FIG. 1 shown on a larger scale, FIG. 3 is the section along line III—III of FIG. 1 on the scale of FIG. 2, FIG. 4 is the section along line IV—IV of FIG. 1 on the scale of FIG. 2, FIG. 5 is the section along line V—V of FIG. 2, FIG. 6 shows the front panel of FIG. 1, on a larger scale, of the unit selecting and displaying the stitch depth, and FIG. 7 is a block diagram of the electric control circuit for the selection, setting and display of the stitching depth.

FIG. 1 shows a warp-stitch, blind-stitch sewing machine for point-wise sewing by means of a predetermined number of stitches forming a so-called point-lock. The blind-stitching machine comprises a stitching plate 1, an arc needle 2, a gripper 3, a fabric presser 4 and a fabric bender 5, further a housing 6 forming an upper arm 7, a column 8 and a lower arm 9.

The stitching plate 1 extends horizontally at the upper arm 7 which is further provided with a needle lever 11 pivoting to and fro about an axis 10 parallel to the stitching plate 1 and bearing the arc needle 2 and with the gripper 3 supported rotatably about an axis 12.

For synchronously driving the needle lever 11 and the gripper 3, there is provided a main shaft 13 with a manual wheel 14 and a first belt pulley 15 that together with a second belt pulley 16 is looped by an endless V-belt 17, this main shaft 13 being rotatably supported in the upper arm 7. The second belt pulley 16 is rotated by an electric motor mounted in a housing box 18 fastened to the lower side of a table base 19 supporting the housing 6.

The fabric bender 5 together with the fabric presser 4 can be adjusted perpendicularly to the stitching plate 1 from the operational sewing position of FIG. 1 into an inoperative position to release the material having been sewn or to allow the material to be sewn to be inserted, and vice-versa, and includes a shank 20 supported in axially displaceable manner in the lower arm 9, the fabric presser 4 being displaceable on this shank 20 between an adjusting ring 21 mounted on it and an outer ring shoulder 22 of this shank. A helical compression spring 23 is clamped between the fabric presser 4 and the adjusting ring 21 and forces the fabric presser 4 in the sewing position of FIG. 1 against the stitching plate 1 and in the release position against the annular shoulder 22 of the shank 20. A rocker shaft 24 rotatably supported on the lower arm 9 is used to jointly displace the fabric presser 4 and the fabric bender 5; this rocker shaft 24 is connected by a Cardan shaft 25 to an electric rotary magnet 26 and includes a radial arm 27 of which the free end is linked by a connecting strap 28 to the adjoining free end of the shank 20.

To sew a lock-point, it suffices to place the material to be sewn into the blind-stitching machine and to position it between the stitching plate 1 and the fabric presser 4 which jointly with the fabric bender 5 is in the release position, i.e., is lifted from the stitching plate 1, and further to depress a pedal 31 pivotably supported on a foot 29 of a table base support 30, this pedal 31 being connected by a linkage 32 to a switch lever 33 of an electric control circuit disposed in the housing box 18 and controlling the electric rotary magnet 26 and the electric drive motor of the main shaft 13. First the electric rotary magnet 26 is powered to move the fabric presser 4 and the fabric bender 5 into the sewing position wherein the fabric presser 4 forces the the material to be sewn against the side of the stitching plate 1 which is away from the arc needle 2 and the gripper 3 and wherein the fabric bender 5 makes the material to be sewn bulge through an aperture 34 of the stitching plate 1 into the trajectory of the arc needle 2. Then the electric drive motor of the main shaft 13 is turned on to set the arc needle 2 and the gripper 3 in motion.

The arc needle 2 fastened to the free end of the needle lever 11 for every cycle of pivoting of this needle lever 11 swings parallel to the plane of the drawing of FIG. 1 along a path in the form of an arc of circle concentric to the pivot axis 10 of the needle lever 11 and in to and fro manner, namely toward the gripper 3 and then away from it, this gripper 3 rotating synchronously with the swinging of the arc needle 2 about the axis 12 in order to loop jointly with the arc needle 2 the sewing thread passing through this needle's eyelet in a warp-stitching manner. Additionally the arc needle 2 swings laterally to pierce alternatingly at two locations mutually spaced along a line parallel to the pivot axis 10 of the needle lever 11 through the material being sewn which is bulged out by the fabric bender 5, the needle lever 11 being displaced correspondingly by a appropriate mechanism driven by the main shaft 13.

The moment a predetermined number of stitches, that is adjustable by an external rotary knob 35 disposed at the housing box 18 with and acting on the electric control circuit, has been performed without moving the material being sewn first, the electric drive motor of the main shaft 13 is shut off to immobilize the arc needle 2 and the gripper 3, in such a manner that the arc needle 2 remains fixed in the retracted position from the sewn material. Then the sewing thread is pulled out by means of a lever and cut by means of a blade each actuated by an electric rotary magnet controlled by the electric control circuit in the housing box 18. Lastly the electric rotary magnet 26 is de-energized, whereby the fabric presser 4 and the fabric bender 5 move away from the stitching plate 1 and into the release position so that the material having been sewn can be removed from the blind-stitch sewing machine or can be positioned in another way to sew a new point-lock, this process being initiated by the described depressing of the pedal 31. After this initiation, the pedal 31 can be released again because thereupon the electric control circuit in the housing box 18 assures fully automatic operation of the blind-stitch sewing machine, all the above described operations taking place automatically.

The distance between the fabric bender 5 in the sewing position and the arcuate trajectory of the arc needle 2 defining the latter's stitching depth in the particular material to be sewn is determined by a stop 40 for the rocking shaft 24 limiting its pivot motion when the electric rotary magnet 26 is energized. The stop 40 is adjustable to set the stitching depth of the arc needle 2 in relation to the particular material to be sewn, in particular in relation to the number and/or the thickness of the layers of the material to be sewn, namely by means of a stepping drive 41 having an electric control circuit 42 connected to a stitch-depth selector 43, an analog stitch-depth display 44 and a digital stitch-depth display 45.

The stop 40 cooperates with a second radial arm 46 of the rocker shaft 24 and is designed as a rotating cam 47 of which the spiral-shaped periphery forms a stop surface 48 for the arm 46 as shown especially clearly by FIG. 4. As shown by FIG. 2, the cam 47 is mounted on a shaft 49 extending parallel to the rocker shaft 24 in the lower arm 9 and which is rotatably supported by a U-shaped bearing 50 mounted to this lower arm 9 and is connected at one end to the stepping drive 41. This stepping drive 41 is fastened to an arm 51 mounted to the bearing 50 and consists of an electric stepping motor 52 and of a reduction gear unit 53 following same and connected by its output shaft 54 to the shaft 49.

The cam 47 rotates to and fro by means of the stepping drive 41 between the two rotary positions shown in FIG. 4 by solid and respectively dashed lines and defining resp. the highest and lowest sewing position of the fabric bender 5 shown in solid and respectively dashed lines in FIG. 3 into which this bender upon energization of the electric rotary magnet 26 is adjustable through the Cardan shaft 25, the rocker shaft 24 and latter's first arm 27 and the connection strap 28 until the free end of the second arm 46 of the rocker shaft 24 rest radially against the stop surface 48 of the cam 47, and wherein the fabric bender 5 assumes the least and largest distance resp. from the trajectory of the arc needle 2, where therefore there is the greatest or least resp. depth of stitching of the arc needle 2 in the particular material to be sewn.

In order to pass from the rotary position shown in solid lines in FIG. 4 into that shown by the dashed lines or vice-versa from the last-cited rotary position into the former, the cam 47 must be rotated by an angle alpha of 309° counterclockwise and clockwise resp., 1000 steps from the stepping drive 41 being associated with this angle alpha. Accordingly the cam 47 can be rotated stepwise each time by an angle of 0.309° both counterclockwise and clockwise depending on the direction of rotation of the stepping drive 41.

To set a particular sewing position of the fabric bender 5 or a particular distance of the fabric bender 5 when in the sewing position from the trajectory of the arc needle 2 and hence its stitching depth in the material to be sewn, the cam 47 is rotated into a particular rotational position starting from the central rotational position between the two rotational positions shown in FIG. 4 wherein the cam 47 cooperates with the free end of the second arm 46 of the rocker shaft 24 at a location 55 of the stop surface 48 and from which the cam 47 is rotated counterclockwise or clockwise by a corresponding number of steps by means of the stepping drive 41 correspondingly controlled by the electric control circuit 42 depending on the required rotational position of the cam 47 with respect to the second arm 46 of the rocking shaft 24 being on one or the other side of its central rotational position from where the cam 47 must be rotated in 500 steps through the angle ½ alpha=154.5° clockwise or counter-clockwise in order to arrive at the rotational positions shown in FIG. 4 in solid and dashed lines resp.

The central position of rotation of the cam 47 is determined by an optical position generator 56 consisting as shown by FIG. 2 of an optical sensor 57 mounted in the lower arm 9 and having a light emitter and a light detector and of a masking disk 58 provided on the shaft 49 of the cam 47 to interrupt the light beam 59 between the light emitter and the light detector of the optical sensor 57. In the rotational positions of the cam 47 with respect to the free end of the second arm 46 of the rocker shaft 24 as shown in FIG. 4 in solid and respectively dashed lines, the semi-circular masking disk 58 assumes the rotational positions relative to the optical sensor 57 and its light beam 59 as shown in FIG. 5 in solid and dashed lines, respectively. If the cam 47 is rotated counterclockwise from the rotational position shown in solid lines in FIG. 4 into the rotational position shown in dashed lines in FIG. 4, then the masking disk 58 rotates from the rotational position shown in solid lines in FIG. 5 in counterclockwise manner into the rotational position shown by dashed lines in FIG. 5, sweeping through an angle alpha of 309° and after the first half of this rotation interrupting the light beam 59 of the optical sensor 57 so that the electrical output of this sensor changes from a value corresponding to a logic 1 to a logic a value corresponding to 0. The output signal of the optical sensor 57 is applied to the electric control circuit 42 which receives therefore in every rotational position of the masking disk 58 for which its radial control edge 60 in FIG. 5 is located to the right of the light beam 59 of the optical sensor 57 and in which the cam 47 assumes a rotational position between that shown in solid lines in FIG. 4 and the central one the output signal "1", and receives in all rotational positions of the masking disk 58 in which its radial control edge 60 in FIG. 5 is on the left of the light beam 59 of the optical sensor 57 and in which the cam 47 assumes a rotational position between that indicated in dashed lines in FIG. 4 and the central one the output signal "0".

The electric control circuit 42 is mounted in a housing box 61 having a front panel 62 provided with the stitch-depth selector 43, the analog stitch-depth display 44 and the digital stitch-depth display 45 as shown especially clearly in FIG. 6. The stitch-depth selector 43 consists of eight keys 63 to each of which is associated a specific distance between the fabric bender 5 in the sewing position and the trajectory of the arc needle 2, stored in the electric control circuit 42 and fetchable by actuating the particular key 63 to feed a corresponding actuation signal to the stepping drive 41, i.e., to its electric stepping motor 52. The analog and the digital stitch-depth displays 44 and 45 resp. show the particular fetched distance, and a light emitting diode (LED) 64 associated with the actuated key 63 lights up to display the key actuation. The eight LED's 64 for the keys 63 are connected to the electric control circuit 42 and are disposed on the front panel 62 of the housing box 61 in a row, each above the associated key 63, the box being movably mounted to the housing 6 of the blind-stitching machine whereby the operating personnel can move the housing box 61 in the most advantageous position for the actuation of the keys 63 and three further keys 65, 66 and 67 at the front panel 62 and for observing the analog stitch-depth display 44, the digital stitch-depth display 45 and the LED's 64 at the front panel 62.

The analog stitch-depth display 44 is provided with a row 68 of LED's which will light up the more in direction of the arrow 69 of FIG. 6 the larger the distance fetched from the electric control circuit 42 between the fabric bender 5 in the sewing position and the trajectory of the arc needle 2. The digital stitch-depth display 45 has 21 LED's 70 to display each digit of a three-place decimal number in seven segments and therefore can display all decimal numbers from 0 to 999. The displayed decimal number will be the larger the greater the distance fetched from the electric control circuit 42 between the fabric bender 5 in the sewing position and the trajectory of the arc needle 2.

The distances stored in the electric control circuit 42 between the fabric bender 5 in its sewing position and the trajectory of the arc needle 2 may each be changed by means of the further keys 65 through 67 at the front panel 62 of the housing box 61. The particular key 63 is then actuated, the associated LED 64 lighting up, also the row 68 of the LED's of the analog stitch-depth display 44 along the corresponding length, and the LED's 70 of the digital stitch-depth display 45, to indicate the corresponding decimal number. By actuating the key 65 or the key 66, the stored distance is made smaller or larger resp., the displays of the analog stitch-depth indicator 44 and of the digital stitch-depth indicator 45 changing correspondingly. Thereupon the key 67 is actuated to definitively store the new distance between the fabric bender 5 in the sewing position and the trajectory of the arc needle 2 for the actuated key 63 in the electric control circuit 42.

The electric control circuit 42 operates digitally and as shown in FIG. 7 includes a read-write memory 71, a microprocessor 72, a program memory 73, an interface module 74 and an address decoder 75. The read-write memory 71 stores the eight different distances, between the fabric bender 5 in the sewing position and the trajectory of the arc needle 2, which are associated to the eight keys 63 of the stitch-depth selector 43. The microprocessor 72 controls the operations in the electric control circuit 42 in a clocked manner using the clock pulses of a clock pulse generator and according to the programming contained in the program memory 73. The interface module 74 connects the stepping drive 41, i.e., two decoder and driver units 76 for its electric stepping motor 52, the stitch-depth selector 43, i.e., its keys 63, and the further three keys 65, 66 and 67, the analog stitch-depth display 44, i.e. a shift register 77 for its row 68 of LED's, the digital stitch-depth display 45, i.e. a shift register 78 for its LED's 70, the optical position generator 56, i.e. its optical sensor 57, the LED's 64, i.e., a shift register 79, therefor a monitoring system 80 for the fabric bender 5 and an associated acoustic alarm 81, i.e., a driver unit 82 therefor to the remaining components of the electric control circuit 42.

The read-write memory 71, the microprocessor 72, the program memory 73 and the interface module 74 are connected to a data bus D and an address bus A as shown by FIG. 7. The address decoder 75 is connected only to the address bus A and can be fed from the microprocessor 72 with an activation signal through a line 83 to apply chip selection signals through lines 84 to the read-write memory 71, the program memory 73 and the interface module 74. The read-write memory 71 and the interface module 74 furthermore can be fed with read and write signals from the microprocessor 72 through a line 85. In case of malfunction, the interface module 74 emits a corresponding signal through a line 86 to the microprocessor 72. When the blind stitching machine is turned on by its main switch and receives the mains voltage, the microprocessor 72, the interface module 74 and the three shift registers 77, 78 and 79 receive a reset signal through a line 87 and thereby are reset.

As shown in FIG. 7, the three shift registers 78, 79 and 77 of the digital stitch-depth display 45, and respectively of the LED's 64 of the keys 63 of the stitch-depth selector 43 or of the analog stitch-depth display 44 are fed serially by the interface module 74 through a line 88, while the driver unit 82 of the acoustic alarm 81 and the two decoder and driver units 76 of the electric stepping motor 52 of the stepping drive 41 on the other hand are fed in parallel through a line 89 and respectively two lines 90. Also, the keys 63 of the stitch depth selector 43 and the three additional keys 65, 66 and 67, the optical sensor 57 of the optical position generator 56 and the monitoring system 80 for the fabric bender 5 feed signals to the interface module 74 in parallel through lines 91, 92 and respectively 93.

When the stepping drive 41, i.e. its electric stepping motor 52 has been energized to rotate the cam 47, the second arm 46 of the rocker shaft 24 shall not rest against the stop surface 48 of the cam 47 so that the rotation of the cam 47 will not be hampered and will take place as accurately as possible. The monitoring system 80 for the fabric bender 5 feeds a signal through the line 93 to the interface module 74 if the fabric bender 5 is in the sewing position, that is if the arm 46 lies against the stop surface 48 and the electric rotary magnet 26 is energized. The monitoring system 80 therefore can also be designed and arranged to monitor the energization of the electric rotary magnet 26 and to feed the interface module 74 through the line 93 with a corresponding signal as long as the electric rotary magnet 26 is energized. In case the stitch-depth selector 43, ie one of its keys 63, is actuated during the presence of the signal of the monitoring system 80, the interface module 74 will apply through the line 89 a signal to the driver unit 82 whereby the acoustic alarm 81 is activated. Provision may be additionally made that in this condition the digital stitch-depth display 45 shall blink.

In order to set a particular stitching depth of the arc needle 2 in the material to be sewn, the operating personnel only need actuate that key 63 of the stitch-depth selector 43 at the front panel 62 of the housing box 61 of the stitch-depth selector and display unit of FIG. 6 which is associated to the corresponding distance of the fabric bender 5 from the trajectory of the arc needle 2 when it has been moved into the sewing position by the electric rotary magnet 26, the LED 64 associated with the key 63 then lighting up. Thereupon the memory contact associated with the key 63 is fetched from the read-write memory 71 of the electric control circuit 42 for the stitch-depth selection, setting and display of FIG. 7 in order to be displayed by the analog stitch-depth display 44 and the digital stitch-depth display 45 and to achieve a corresponding rotational setting of the cam 47 in relation to the free end of the radial arm 46 of the rocker shaft 24 by means of the stepping drive 41. In this operation the stepping drive 41 rotates the cam 47 step-by-step initially in the shortest possible manner into its central rotational position because being set in motion by a corresponding ON signal from the electric control circuit 42 in the particular direction, since the control circuit "knows" whether the cam 47 is on one or the other side of its central rotational position, being then fed by the optical position generator 56 with its output signal "1" or "0". Thereupon the stepping drive 41 rotates the cam 47 step-by-step from the central rotational position according to the ON signal obtained from the electric control circuit 42 into that direction of rotation and by that number of steps as are predetermined from the fetched memory content whereby the cam 47 attains along the shortest possible way the rotational position corresponding to the memory content. If now the electric rotary magnet 26 is energized to move the fabric bender 5 into the sewing position, then the fabric bender 5 can only approach the arcuate trajectory of the arc needle 2 as closely as corresponds to the set rotational position of the cam 47 because the motion of the fabric bender 5 is possible only as far as allowed by the radial arm 46 of the rocker shaft 24 coming to rest against the spiral-shaped stop surface 48 of the cam 47.

We claim:

1. A blind-stitch sewing machine of the type on which the fabric bender is adjustable by means of a rocker shaft between a sewing position wherein the material being sewn is caused to bulge into the arcuate trajectory of an arc needle, and a release position wherein the material being sewn is permitted to be inserted and removed, the rocker shaft cooperating with a stop defining the sewing position of the fabric bender, and the stop being adjustable for setting the stitch-depth of the arc needle in the particular material to be sewn so that a corresponding distance between the fabric bender in the sewing position and the trajectory of the arc needle may be assured, which machine comprises: an adjustable stop (40) in the form of a cam (47) which is rotatable by means of an electric stepping motor (52) connected to an electric control circuit (42) having a memory (71) for plural different distances between the fabric bender (5) in the sewing position and the trajectory of the arc needle (2) in accordance with the particular distance fetched from the memory (71) upon the actuation of a manual stitch-depth selector (43) connected to the electric control circuit (42).

2. The blind-stitch sewing machine according to claim 1 wherein the cam (47) is supported on a shaft (49) disposed parallel to the rocker shaft (24) and includes a spiral periphery defining a stop surface (48) for a radial arm (46) of the rocker shaft (24).

3. The blind-stitch sewing machine according to claim 1 or 2, wherein with every change of the distance between the fabric bender (5) in the sewing position and the trajectory of the arc needle (2), the cam (47) may be rotated by the electric stepping motor (52) into a first position wherein the (cam 47) is positioned at the center of its entire range of rotation, and then from the first position in either direction into a subsequent new position, and including a position generator (56) for emitting first and second output signals to the electric control circuit (42) when the cam (47) is rotated from its first position in the one and other direction, respectively.

4. The blind-stitch sewing machine according to claim 1 or 2, further including an analog stitch-depth display (44) comprising a row (68) of light emitting diodes and/or a digital stitch-depth display (45) comprising light emitting diodes (70) for a multisegment display of the digits of decimal numbers and connected to the electric control circuit (42).

5. The blind-stitch sewing machine of claim 1 or 2, wherein the stitch-depth selector (43) includes a plurality of keys (63), each key (63) being associated with a specific distance between the fabric bender (5) in the sewing position and the trajectory of the arc needle (2).

6. The blind-stitch sewing machine according to claim 5 further including an analog stitch-depth display (44) comprising a row (68) of light emitting diodes and/or a digital stitch-depth display (45) comprising light emitting diodes (70) for a multisegment display of the digits of decimal numbers and connected to the electric control circuit (42), the plural keys (63) each being actuatable to change the associated distance between the fabric bender (5) in the sewing position and the trajectory of the arc needle (2) stored in the memory (71), and further including three additional keys (65, 66, 67) connected to the electric control circuit (42), with each additional key being actuatable for, respectively, reducing or enlarging the distance with a corresponding change of the display of the analog display (44) or digital display (45), or respectively for feeding the new distance into the memory (71).

* * * * *

UNITED STATES PATENT AND TRADEMARK OFFICE

CERTIFICATE OF CORRECTION

PATENT NO. : 4,718,365

DATED : January 12, 1988

INVENTOR(S) : HAUSER et al

It is certified that error appears in the above-identified patent and that said Letters Patent is hereby corrected as shown below: Title page:

Assignee: J.STROBEL & SÖHNE GMBH & CO

Column 4, line 3, delete "with";

Column 5, line 56, delete "a" at the end of the line;

line 57, delete "logic", and insert between "to" and "0"
— a logic —;

Column 7, line 37, delete "or", and insert therefor:
— and respectively —;

Column 8, line 13, delete "contact", and insert therefor:
— content —;

CLAIM 3, Column 9, line 12, correct "(cam 47)" to read:
— cam (47) —.

Signed and Sealed this

Thirteenth Day of December, 1988

*Attest:*

DONALD J. QUIGG

*Attesting Officer*

*Commissioner of Patents and Trademarks*